US008760061B2

(12) United States Patent
Peng

(10) Patent No.: US 8,760,061 B2
(45) Date of Patent: Jun. 24, 2014

(54) LED LIGHT STRING COLOR MIXING AND SYNCHRONIZATION CIRCUIT

(71) Applicant: Mei-Ling Peng, Hsinchu (TW)

(72) Inventor: Mei-Ling Peng, Hsinchu (TW)

( * ) Notice: Subject to any disclaimer, the term of this patent is extended or adjusted under 35 U.S.C. 154(b) by 41 days.

(21) Appl. No.: 13/688,168

(22) Filed: Nov. 28, 2012

(65) Prior Publication Data

US 2014/0145630 A1 May 29, 2014

(51) Int. Cl.
*H05B 37/00* (2006.01)

(52) U.S. Cl.
USPC ..... 315/185 R; 315/185 S; 315/192; 315/294; 362/249.06; 362/249.14; 362/653; 362/654

(58) Field of Classification Search
CPC ..... H05B 33/0803; H05B 33/0806; H05B 33/0842; H05B 37/02; F21Y 2101/02; F21S 4/001; F21W 2121/00; F21W 2121/04
USPC ..... 315/185 R, 185 S, 192, 196, 294, 312; 362/249.06, 294.14, 648, 653, 654, 362/659
See application file for complete search history.

(56) References Cited

U.S. PATENT DOCUMENTS

| | | | | |
|---|---|---|---|---|
| 4,675,575 | A * | 6/1987 | Smith et al. | 315/185 S |
| 6,072,280 | A * | 6/2000 | Allen | 315/185 S |
| 8,132,955 | B2 * | 3/2012 | Fan | 362/645 |
| 8,651,700 | B2 * | 2/2014 | Peng | 362/249.06 |
| 2010/0289415 | A1 * | 11/2010 | Chen | 315/185 R |
| 2013/0147369 | A1 * | 6/2013 | Zhang | 315/185 R |

* cited by examiner

*Primary Examiner* — Haiss Philogene
(74) *Attorney, Agent, or Firm* — Leong C. Lei

(57) ABSTRACT

The present invention provides an LED light string color mixing and synchronization circuit, in which each of LED lights composed of an LED light string includes two input terminals and two output terminals. The two input terminals are respectively an input terminal of reverse parallel connection of any two of three primary light-emitting chips of R, G, B and an anode input terminal of the remaining primary light-emitting chip and the two output terminals are respectively an output terminal of reverse parallel connection of any two of three primary light-emitting chips of R, G, B and a cathode output terminal of the remaining primary light-emitting chip. Thus, each of the LED lights of the LED light string is connected in a two-input two-output series connection to form a light string arrangement with two terminals thereof in combination with four electrical wires.

7 Claims, 7 Drawing Sheets

LED LIGHT STRING COLOR MIXING AND SYNCHRONIZATION CIRCUIT

TECHNICAL FIELD OF THE INVENTION

The present invention generally relates to an LED light string color mixing and synchronization circuit, and more particularly to electrical connection of three primary color light-emitting chips of R, G, B of each LED light of the LED light string that allows LED lights to be connected in series to form an LED light string.

DESCRIPTION OF THE PRIOR ART

In the known technology of light string composed of LED lights comprising color light-emitting chips, electrical connection of the three primary color light-emitting chips of R, G, B of each LED light in the LED light string is generally a parallel connection structure with a common cathode or a common anode and all the lights are connected in series when put in use. The shortcomings are that (1) the electrical current of the light string is large, making it not possible to make a light string of a large number of lights; (2) no high voltage can be applied; and (3) eight wires are needed for the light string, generally leading to a waste of cost. Another known way is inclusion an IC (Integrated Circuit) in each light. A light string of this way is not capable of synchronous change of color and the inclusion of an IC in each light also increases the cost. Thus, the conventional synchronous color changing LED light string adopts parallel connection of each LED light, as shown in FIGS. 1 and 2. The parallel arrangement allows each LED light of the LED light string to be connected to form a light string with four terminals thereof used in combination with eight electrical wires. In this way, the volume and weight of the light string are both increased and the manufacturing cost is also increased.

SUMMARY OF THE INVENTION

In order to overcome the drawbacks of the known technology that a plurality of LED lights must be connected in parallel to form an LED light string, synchronous color change of the primary color light-emitting chips of each LED light is not possible, the volume and weight of the light string so formed are both increased, and the manufacturing cost is substantially increased, the present invention provides a novel connection arrangement of light-emitting chips of an LED light, which allows a plurality of LED lights to be connected in series to form an LED light string so as to reduce the number of integrated circuit control chips used is reduced and synchronous color change of the light-emitting chips can be realized.

The technical solution adopted in the present invention is that each of LED lights composed of an LED light string comprises two input terminals and two output terminals, wherein the two input terminals are respectively an input terminal of reverse parallel connection of any two of three primary light-emitting chips of R, G, B and an anode input terminal of the remaining primary light-emitting chip and the two output terminals are respectively an output terminal of reverse parallel connection of any two of three primary light-emitting chips of R, G, B and a cathode output terminal of the remaining primary light-emitting chip. Thus, each of the LED lights of the LED light suing is connected in a two-input two-output series connection to form a light string arrangement with two terminals thereof in combination with four electrical wires. The advantage of the present invention is that the structure is simple and connection of a group of LED lights in series for proper operation can be realized through a minimum number of connection wires with modification being only made on electrical connection among the three primary light-emitting chips of R, G, B so as to reduce the number of IC control chips used and achieve synchronous color change of the light-emitting chips The advantage of the present invention is that the structure is simple and connection of a group of LED lights in series for proper operation can be realized through a minimum number of connection wires with modification being only made on electrical connection among the three primary light-emitting chips of R, G, B so as to reduce the number of IC control chips used and achieve synchronous color change of the light-emitting chips.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
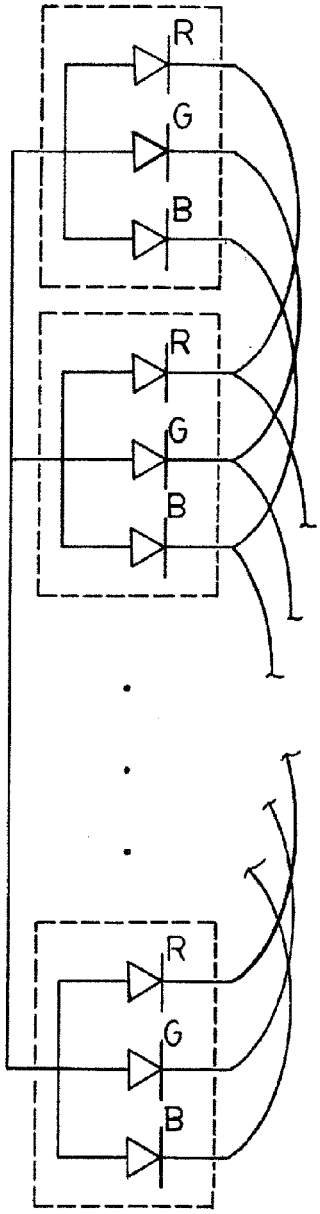
FIG.1 PRIOR ART
FIG. 1 is a view illustrating common anode parallel connection of LED lights of a conventional LED light string.
Figure 2:
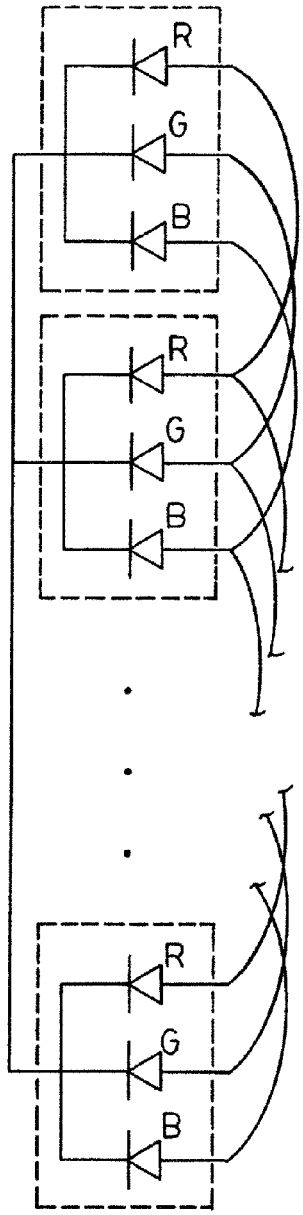
FIG.2 PRIOR ART
FIG. 2 is a view illustrating common cathode parallel connection of LED lights of a conventional LED light string.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Referring to the drawings, the present invention provides an LED light string color mixing and synchronization circuit, which is characterized in that each LED light (20) of an LED light string comprises two input terminals and two output terminals, wherein the two input terminals are respectively an input terminal of reverse parallel connection of any two of three primary light-emitting chips of R, G, B and an anode input terminal of the remaining primary light-emitting chip and the two output terminals are respectively an output terminal of reverse parallel connection of any two of three primary light-emitting chips of R, G, B and a cathode output terminal of the remaining primary light-emitting chip. Thus, each LED light of the LED light string is connected in a two-input two-output series connection to form a light string arrangement with two terminals thereof in combination with four electrical wires (11), (12), (13), (14). The advantage of the present invention is that the structure is simple and connection of a group of LED lights in series for proper operation can be realized through a minimum number of connection wires with modification being only made on electrical connection among the three primary light-emitting chips of R, G, B so as to reduce the number of IC control chips used and achieve synchronous color change of the light-emitting chips.

Figure 3:
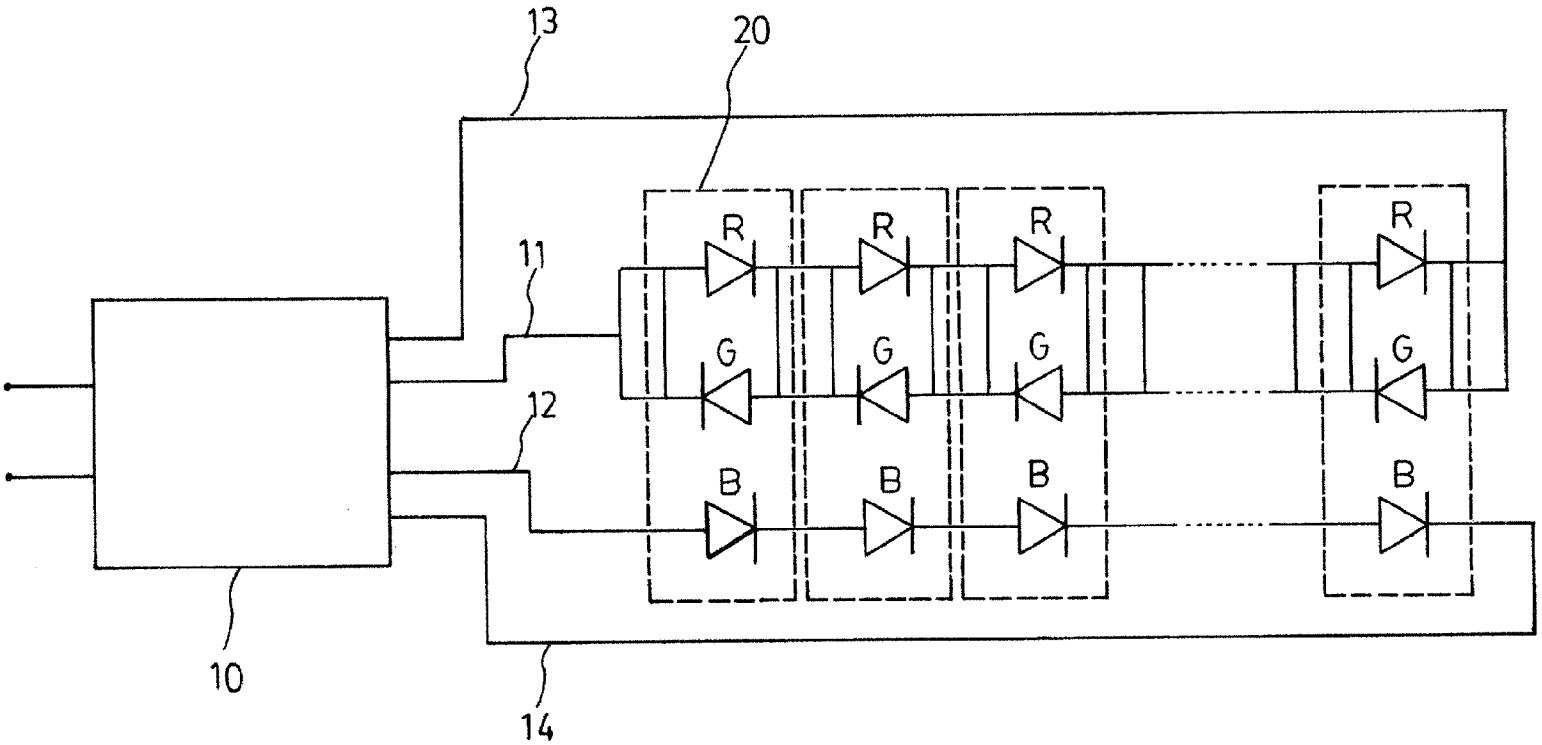
FIG. 3 is a view illustrating a parallel connection arrangement of an LED light string according to a first embodiment of the present invention.

Referring to FIG. 3, in an LED light string according to a first embodiment of the present invention, the connection arrangement of the three primary light-emitting chips of R, G, B of each LED light (20) is such that the two input terminals are respectively an input terminal of parallel connection of an anode of an R primary light-emitting chip and a cathode of a G primary light-emitting chip and an anode input terminal of a B primary light-emitting chip and the two output terminals are respectively an output terminal of parallel connection of a cathode of the R primary light-emitting chip and an anode of the G primary light-emitting chip and a cathode input terminal of the B primary light-emitting chip. The LED light string is controlled by a controller (10) that is provided with four electrical wires (11), (12), (13), (14), among which the electrical wires (11), (12) each have one end connected to the controller (10) and an opposite end connected to an input of the electrical connection of the LED lights (20) and the electrical wires (13), (14) each have an end connected to the controller (10) and an opposite end connected to an output of the electrical connection of the LED lights (20). As such, each LED light (20) of the LED light string is connected in a two-input two-output series connection to form a light string arrangement with two terminals thereof in combination with four electrical wires.

Figure 4:
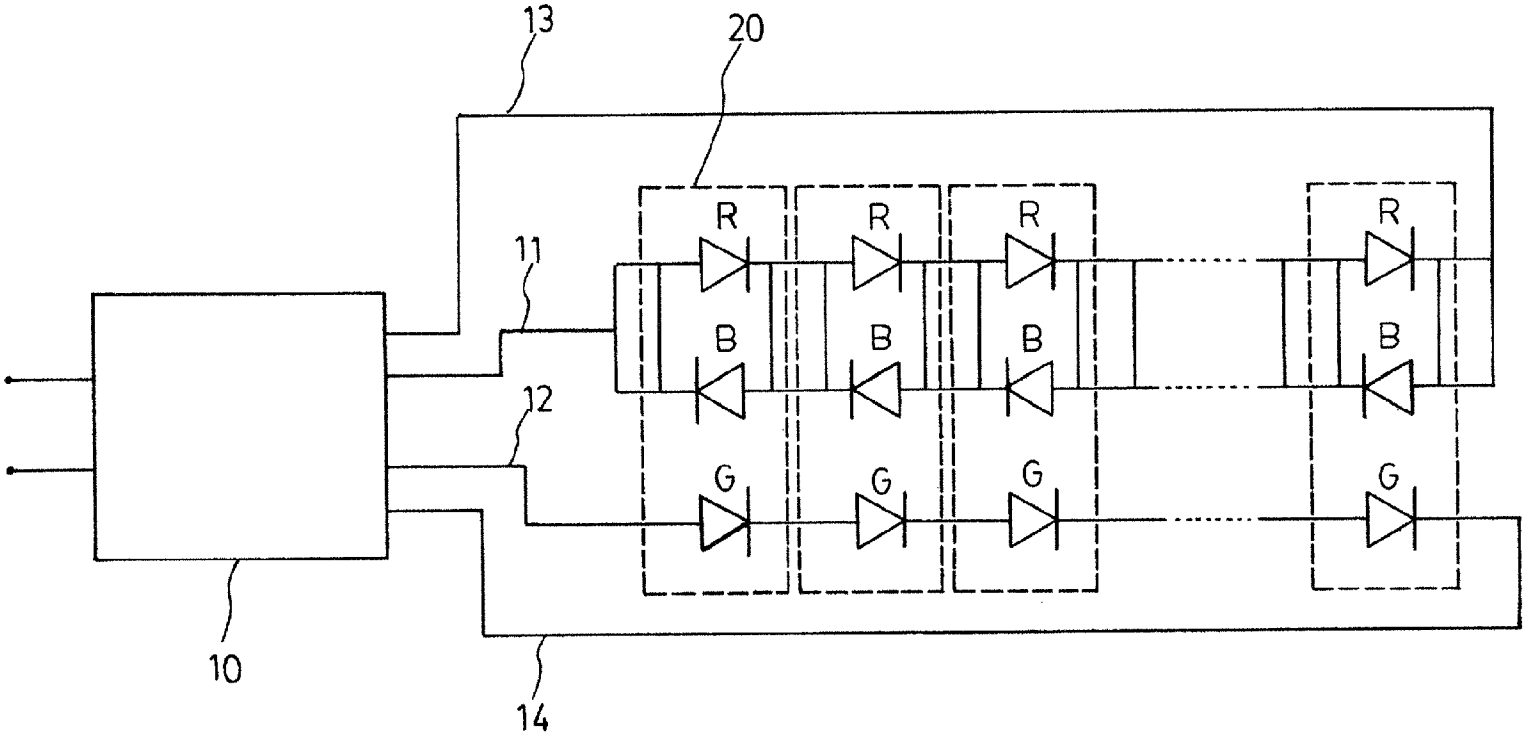
FIG. 4 is a view illustrating a parallel connection arrangement of an LED light string according to a second embodiment of the present invention.

Referring to FIG. 4, in an LED light string according to a second embodiment of the present invention, the connection arrangement of the three primary light-emitting chips of R, G, B of each LED light (20) is such that the two input terminals are respectively an input terminal of parallel connection of an anode of an R primary light-emitting chip and a cathode of a B primary light-emitting chip and an anode input terminal of a G primary light-emitting chip and the two output terminals are respectively an output terminal of parallel connection of a cathode of the R primary light-emitting chip and an anode of the B primary light-emitting chip and a cathode input terminal of the G primary light-emitting chip. The LED light string is controlled by a controller (10) that is provided with four electrical wires (11), (12), (13), (14), among which the electrical wires (11), (12) each have one end connected to the controller (10) and an opposite end connected to an input of the electrical connection of the LED lights (20) and the electrical wires (13), (14) each have an end connected to the controller (10) and an opposite end connected to an output of the electrical connection of the LED lights (20). As such, each LED light (20) of the LED light string is connected in a two-input two-output series connection to form a light string arrangement with two terminals thereof in combination with four electrical wires.

Figure 5:
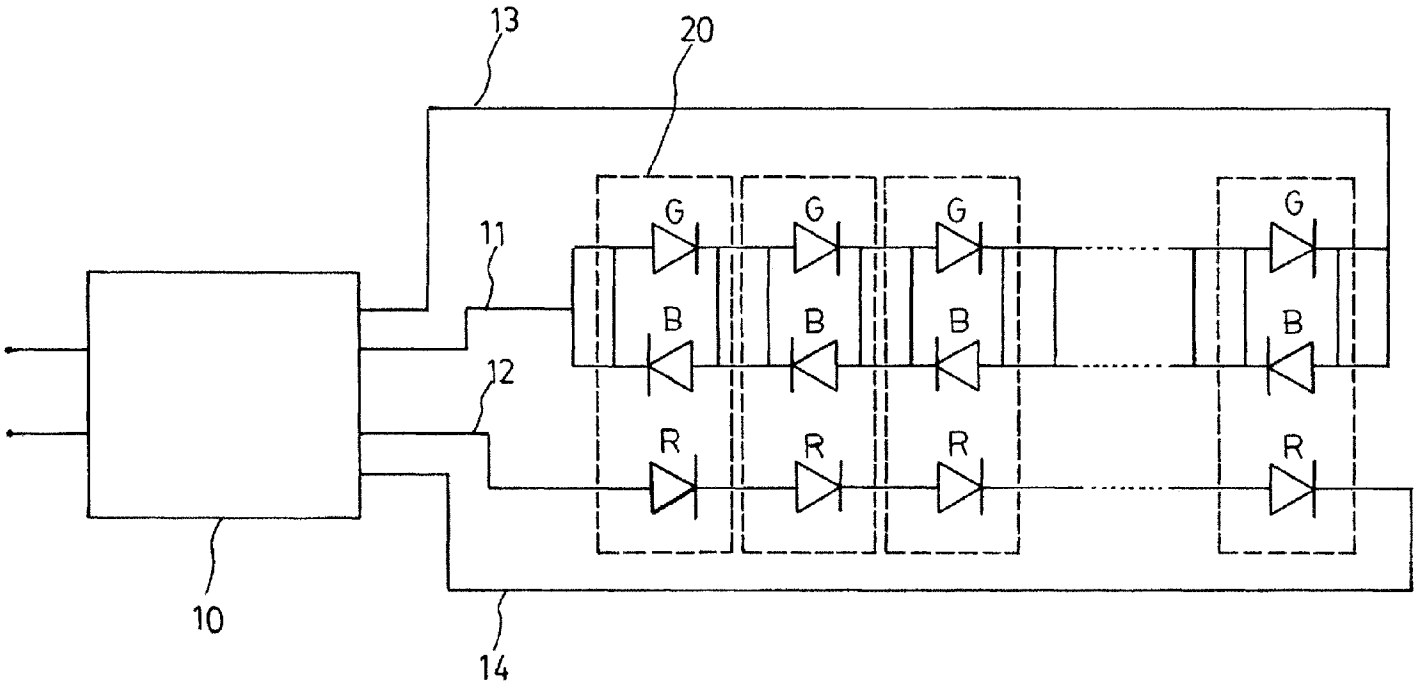
FIG. 5 is a view illustrating a parallel connection arrangement of an LED light string according to a third embodiment of the present invention.

Referring to FIG. 5, in an LED light string according to a third embodiment of the present invention, the connection arrangement of the three primary light-emitting chips of R, G, B of each LED light (20) is such that the two input terminals are respectively an input terminal of parallel connection of an anode of a G primary light-emitting chip and a cathode of a B primary light-emitting chip and an anode input terminal of an R primary light-emitting chip and the two output terminals are respectively an output terminal of parallel connection of a cathode of the G primary light-emitting chip and an anode of the B primary light-emitting chip and a cathode input terminal of the R primary light-emitting chip. The LED light string is controlled by a controller (10) that is provided with four electrical wires (11), (12), (13), (14), among which the electrical wires (11), (12) each have one end connected to the controller (10) and an opposite end connected to an input of the electrical connection of the LED lights (20) and the electrical wires (13), (14) each have an end connected to the controller (10) and an opposite end connected to an output of the electrical connection of the LED lights (20). As such, each LED light (20) of the LED light string is connected in a two-input two-output series connection to form a light string arrangement with two terminals thereof in combination with four electrical wires.

Figure 6:
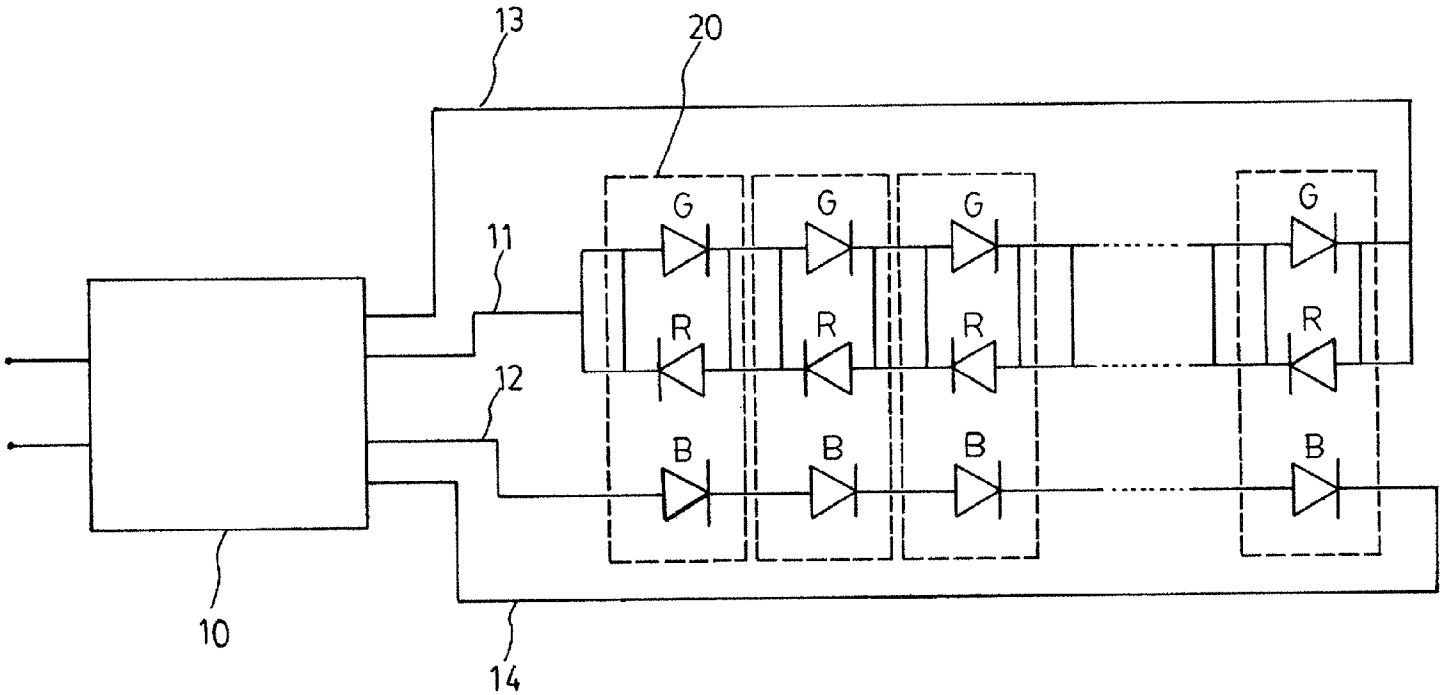
FIG. 6 is a view illustrating a parallel connection arrangement of an LED light string according to a fourth embodiment of the present invention.

Referring to FIG. 6, in an LED light string according to a fourth embodiment of the present invention, the connection arrangement of the three primary light-emitting chips of R, G, B of each LED light (20) is such that the two input terminals are respectively an input terminal of parallel connection of an anode of a G primary light-emitting chip and a cathode of an R primary light-emitting chip and an anode input terminal of a B primary light-emitting chip and the two output terminals are respectively an output terminal of parallel connection of a cathode of the G primary light-emitting chip and an anode of the R primary light-emitting chip and a cathode input terminal of the B primary light-emitting chip. The LED light string is controlled by a controller (10) that is provided with four electrical wires (11), (12), (13), (14), among which the electrical wires (11), (12) each have one end connected to the controller (10) and an opposite end connected to an input of the electrical connection of the LED lights (20) and the electrical wires (13), (14) each have an end connected to the controller (10) and an opposite end connected to an output of the electrical connection of the LED lights (20). As such, each LED light (20) of the LED light string is connected in a two-input two-output series connection to form a light string arrangement with two terminals thereof in combination with four electrical wires.

Figure 7:
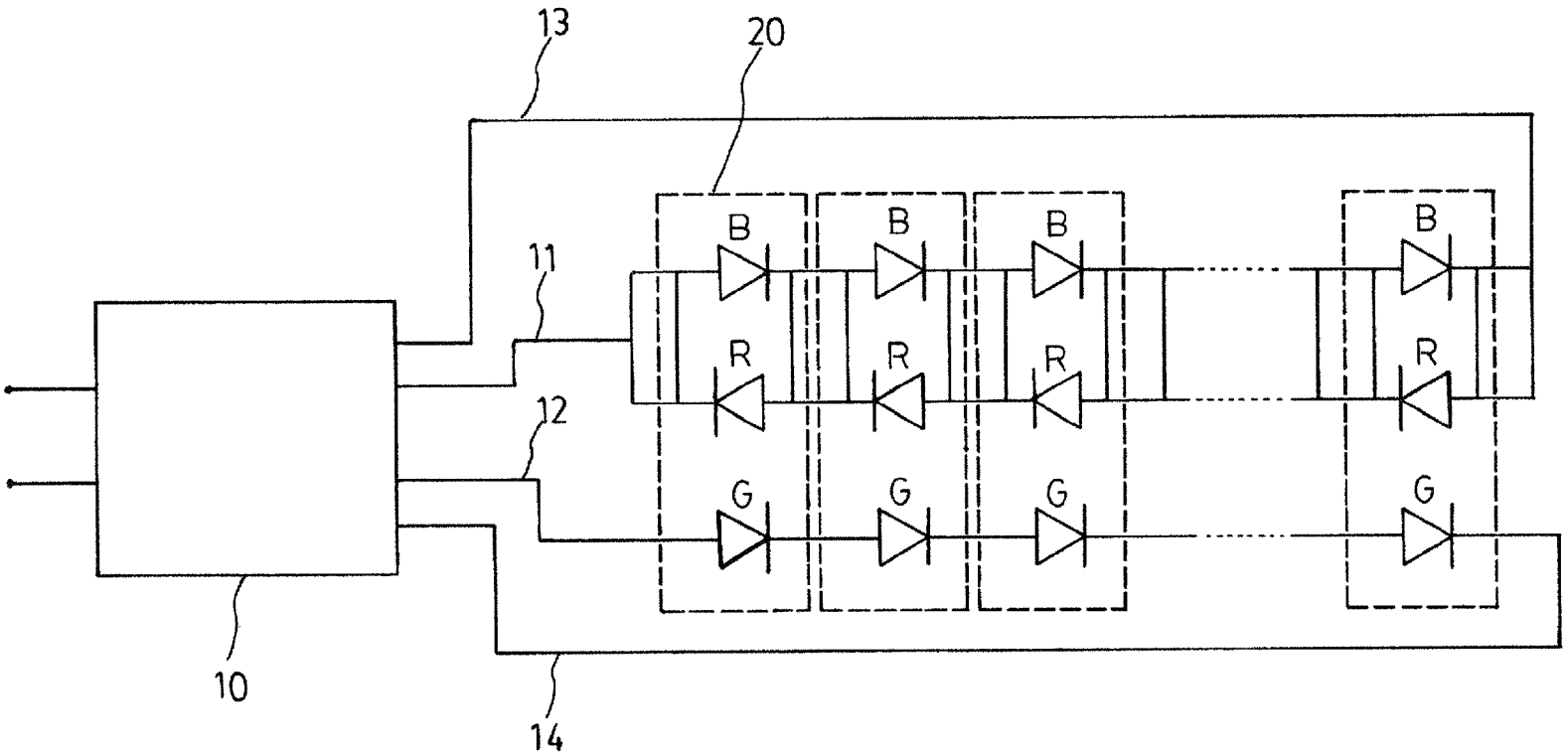
FIG. 7 is a view illustrating a parallel connection arrangement of an LED light string according to a fifth embodiment of the present invention.

Referring to FIG. 7, in an LED light string according to a fifth embodiment of the present invention, the connection arrangement of the three primary light-emitting chips of R, G, B of each LED light (20) is such that the two input terminals are respectively an input terminal of parallel connection of an anode of a B primary light-emitting chip and a cathode of an R primary light-emitting chip and an anode input terminal of a G primary light-emitting chip and the two output terminals are respectively an output terminal of parallel connection of a cathode of the B primary light-emitting chip and an anode of the R primary light-emitting chip and a cathode input terminal of the G primary light-emitting chip. The LED light string is controlled by a controller (10) that is provided with four electrical wires (11), (12), (13), (14), among which the electrical wires (11), (12) each have one end connected to the controller (10) and an opposite end connected to an input of the electrical connection of the LED lights (20) and the electrical wires (13), (14) each have an end connected to the controller (10) and an opposite end connected to an output of the electrical connection of the LED lights (20). As such, each LED light (20) of the LED light string is connected in a two-input two-output series connection to form a light string arrangement with two terminals thereof in combination with four electrical wires.

Figure 8:
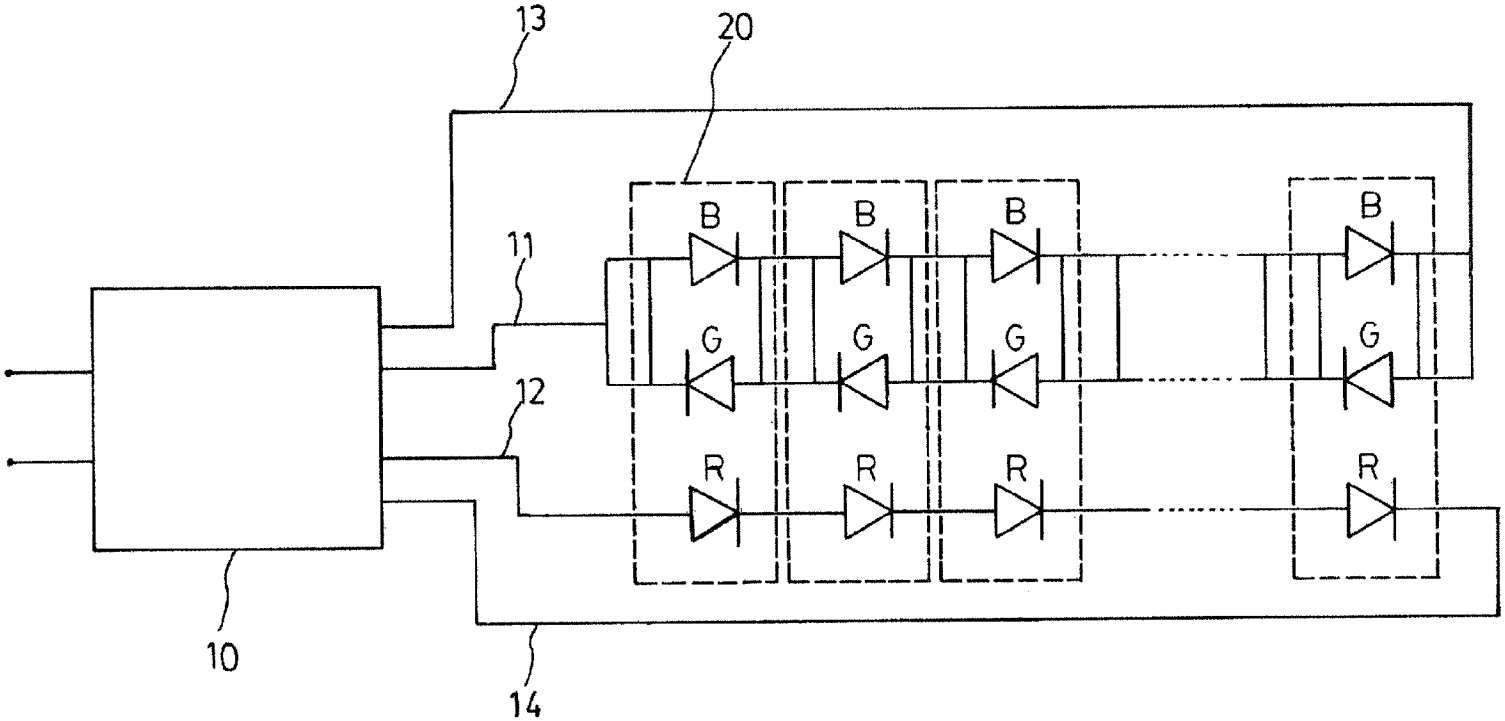
FIG. 8 is a view illustrating a parallel connection arrangement of an LED light string according to a sixth embodiment of the present invention.

Referring to FIG. 8, in an LED light string according to a sixth embodiment of the present invention, the connection arrangement of the three primary light-emitting chips of R, G, B of each LED light (20) is such that the two input terminals are respectively an input terminal of parallel connection of an anode of a B primary light-emitting chip and a cathode of a G primary light-emitting chip and an anode input terminal of an R primary light-emitting chip and the two output terminals are respectively an output terminal of parallel connection of a cathode of the B primary light-emitting chip and an anode of the G primary light-emitting chip and a cathode input terminal of the R primary light-emitting chip. The LED light string is controlled by a controller (10) that is provided with four electrical wires (11), (12), (13), (14), among which the electrical wires (11), (12) each have one end connected to the controller (10) and an opposite end connected to an input of the electrical connection of the LED lights (20) and the electrical wires (13), (14) each have an end connected to the controller (10) and an opposite end connected to an output of the electrical connection of the LED lights (20). As such, each LED light (20) of the LED light string is connected in a two-input two-output series connection to form a light string arrangement with two terminals thereof in combination with four electrical wires.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An LED light string color mixing and synchronization circuit, characterized in that each of LED lights composed of an LED light string comprises two input terminals and two output terminals, wherein the two input terminals are respectively an input terminal of reverse parallel connection of any two of three primary light-emitting chips of R, G, B and an anode input terminal of the remaining primary light-emitting chip and the two output terminals are respectively an output terminal of reverse parallel connection of any two of three primary light-emitting chips of R, G, B and a cathode output terminal of the remaining primary light-emitting chip, whereby each of the LED lights of the LED light string is connected in a two-input two-output series connection to form a light string arrangement with two terminals thereof in combination with four electrical wires.

2. The LED light string color mixing and synchronization circuit according to claim 1, wherein the two input terminals of each of the LED light are respectively an input terminal of parallel connection of an anode of an R primary light-emitting chip and a cathode of a G primary light-emitting chip and an anode input terminal of a B primary light-emitting chip and the two output terminals are respectively an output terminal of parallel connection of a cathode of the R primary light-emitting chip and an anode of the G primary light-emitting chip and a cathode input terminal of the B primary light-emitting chip.

3. The LED light string color mixing and synchronization circuit according to claim 1, wherein the two input terminals of each of the LED lights are respectively an input terminal of parallel connection of an anode of an R primary light-emitting chip and a cathode of a B primary light-emitting chip and an anode input terminal of a G primary light-emitting chip and the two output terminals are respectively an output terminal of parallel connection of a cathode of the R primary light-emitting chip and an anode of the B primary light-emitting chip and a cathode input terminal of the G primary light-emitting chip.

4. The LED light string color mixing and synchronization circuit according to claim 1, wherein the two input terminals of each of the LED lights are respectively an input terminal of parallel connection of an anode of a G primary light-emitting chip and a cathode of a B primary light-emitting chip and an anode input terminal of an R primary light-emitting chip and the two output terminals are respectively an output terminal of parallel connection of a cathode of the G primary light-emitting chip and an anode of the B primary light-emitting chip and a cathode input terminal of the R primary light-emitting chip.

5. The LED light string color mixing and synchronization circuit according to claim 1, wherein the two input terminals are respectively an input terminal of parallel connection of an anode of a G primary light-emitting chip and a cathode of an R primary light-emitting chip and an anode input terminal of a B primary light-emitting chip and the two output terminals are respectively an output terminal of parallel connection of a cathode of the G primary light-emitting chip and an anode of the R primary light-emitting chip and a cathode input terminal of the B primary light-emitting chip.

6. The LED light string color mixing and synchronization circuit according to claim 1, wherein the two input terminals are respectively an input terminal of parallel connection of an anode of a B primary light-emitting chip and a cathode of an R primary light-emitting chip and an anode input terminal of a G primary light-emitting chip and the two output terminals are respectively an output terminal of parallel connection of a cathode of the B primary light-emitting chip and an anode of the R primary light-emitting chip and a cathode input terminal of the G primary light-emitting chip.

7. The LED light string color mixing and synchronization circuit according to claim 1, wherein the two input terminals are respectively an input terminal of parallel connection of an anode of a B primary light-emitting chip and a cathode of a G primary light-emitting chip and an anode input terminal of an R primary light-emitting chip and the two output terminals are respectively an output terminal of parallel connection of a cathode of the B primary light-emitting chip and an anode of the G primary light-emitting chip and a cathode input terminal of the R primary light-emitting chip.

* * * * *